US007327852B2

(12) United States Patent
Ruwisch

(10) Patent No.: US 7,327,852 B2
(45) Date of Patent: Feb. 5, 2008

(54) METHOD AND DEVICE FOR SEPARATING ACOUSTIC SIGNALS

(76) Inventor: Dietmar Ruwisch, Gutenbergstrasse 11, D-12557 Berlin (DE)

( * ) Notice: Subject to any disclaimer, the term of this patent is extended or adjusted under 35 U.S.C. 154(b) by 272 days.

(21) Appl. No.: 10/557,754

(22) PCT Filed: Jan. 31, 2005

(86) PCT No.: PCT/EP2005/050386

§ 371 (c)(1),
(2), (4) Date: Nov. 18, 2005

(87) PCT Pub. No.: WO2005/076659

PCT Pub. Date: Aug. 18, 2005

(65) Prior Publication Data

US 2007/0003074 A1 Jan. 4, 2007

(30) Foreign Application Priority Data

Feb. 6, 2004 (DE) ..... 10 2004 005 998

(51) Int. Cl.
*H04R 25/00* (2006.01)

(52) U.S. Cl. ..... 381/356; 381/91; 381/92; 381/94.7

(58) Field of Classification Search ..... 381/66, 381/71.1, 71.11, 91, 92, 94.2, 94.7, 94.9, 381/122, 356; 379/406.08, 406.12; 704/233, 704/231

See application file for complete search history.

(56) References Cited

U.S. PATENT DOCUMENTS 5,539,859 A 7/1996 Robbe et al. ..... 395/2.42
5,774,562 A * 6/1998 Furuya et al. ..... 381/66
6,654,719 B1 * 11/2003 Papadias ..... 704/233
2004/0037437 A1 * 2/2004 Symons et al. ..... 381/92

FOREIGN PATENT DOCUMENTS

| | | |
|---|---|---|
| DE | 693 14 514 T2 | 2/1998 |
| EP | 0 831 458 A2 | 3/1998 |
| WO | WO 02/061732 A1 | 8/2002 |

* cited by examiner

*Primary Examiner*—Huyen Le
(74) *Attorney, Agent, or Firm*—Marger Johnson & McCollum, P.C.

(57) ABSTRACT

In a method of separating acoustic signals from a plurality of sound sources comprising the following steps: disposing two microphones (MIK1, MIK2) at a predefined distance (d) from one another; picking up the acoustic signals with both microphones (MIK1, MIK2) and generating associated microphone signals (m1, m2); and separating the acoustic signal of one of the sound sources (SI) from the acoustic signals of the other sound sources (S2) on the basis of the microphone output signals (m1, m2), the proposed separation step comprises the following steps: applying a Fourier transform to the microphone output signals in order to determine their frequency spectra (M1, M2); determining the phase difference between the two microphone output signals (m1, m2) for every frequency component of their frequency spectra (M1 , M2); determining the angle of incidence of every acoustic signal allocated to a frequency of the frequency spectra (M1, M2) on the basis of the relative phase angle and the frequency; generating a signal spectrum (5) of a signal to be output by correlating one of the two frequency spectra (M1, M2) with a filter function which is selected so that acoustic signals from an area around a preferred angle of incidence are amplified relative to acoustic signals from outside this area; and applying an inverse Fourier transform to the resultant signal spectrum.

9 Claims, 4 Drawing Sheets

METHOD AND DEVICE FOR SEPARATING ACOUSTIC SIGNALS

The present invention relates to a method and a device for separating acoustic signals.

The invention relates to the field of digital signal processing as a means of separating different acoustic signals from different spatial directions which are stereophonically picked up by two microphones at a known distance.

The field of source separation, also referred to as "beam forming" is gaining in importance due to the increase in mobile communication as well as automatic processing of human speech. In very many applications, one problem which arises is the fact that the desired speech signal (wanted signal) is detrimentally affected by various types of interference. Primary examples of this is interference caused by background noise, interference from other speakers and interference from loudspeaker emissions of music or speech. The various types of interference require different treatments, depending on their nature and depending on what is known about the wanted signal beforehand.

Examples of applications to which the invention lends itself, therefore, are communication systems in which the position of a speaker is known and in which interference occurs due to background noise or other speakers and loudspeaker emissions. Examples of applications are automotive hands-free units, in which the microphones are mounted in the rear-view mirror, for example, and a so-called directional hyperbola is directed towards the driver. In this application, a second directional hyperbola can be directed towards the passenger to permit switching between driver and passenger during a telephone conversation as required.

In situations in which the geometric position of the wanted signal source relative to the receiving microphones is known, geometric source separation is a powerful tool. The standard method of this class of "beam forming" algorithms is the so-called "shift and add" method, whereby a filter is applied to one of the microphone signals and the filtered signal is then added to the second microphone signal (see, for example, Haddad and Benoit, "Capabilities of a beamforming technique for acoustic measurements inside a moving car", The 2002 International Congress and Exposition on Noise Control Engineering, Deaborn, Mich., USA, Aug. 19-21, 2002).

An extension of this method relates to "adaptive beam forming" or "adaptive source separation", where the position of the sources in space is unknown a priori and has to be determined first by algorithms (WO 02/061732, U.S. Pat. No. 6,654,719). In this instance, the aim is to determine the position of the sources in space from the microphone signals and not, as is the case in "geometric" beam forming, to specify it beforehand on a fixed basis. Although adaptive methods have proved very useful, information is usually also necessary a priori in this case because, as a rule, an algorithm can not decide which of the detected speech sources is the wanted signal and which is the interference signal. The disadvantage of all known adaptive methods is the fact that the algorithms need a certain amount of time to adapt before sufficient convergence exists and the source separation is successfully completed. Furthermore, adaptive methods are more susceptible to diffuse background interference in principle because it can significantly impair convergence. A more serious disadvantage with conventional "shift and add" methods is the fact that with two microphones, only two signal sources can be separated from one another and diffuse background noise is not attenuated to a sufficient degree as a rule.

Patent specification DE 69314514 T2 discloses a method of separating acoustic signals of the type outlined in the introductory part of claim 1. The method proposed in this document separates the acoustic signals in such a way that ambient noise is removed from a desired wanted acoustic signal and the examples of applications given include the speech signals of a vehicle passenger which can be understood but only with difficulty due to the general and non-localised vehicle noise.

As a means of filtering out the speech signal, this prior art document proposes a technique whereby a complete acoustic signal is measured with the aid of two microphones, a Fourier transform is applied to each of the two microphone signals in order to determine its frequency spectrum, an angle of incidence of the respective signal is determined in several frequency bands based on the respective phase difference, which is finally followed by the actual "filtering". To this end, a preferred angle of incidence is determined, after which a filter function, namely a noise spectrum, is subtracted from one of the two frequency spectra, and this noise spectrum is selected so that acoustic signals from the area around the preferred angle of incidence assigned to the speaker are amplified relative to the other acoustic signals which essentially represent background noise of the vehicle. Having been filtered in this manner, an inverse Fourier transform is then applied to the frequency spectrum which is output as a filtered acoustic signal.

The method disclosed in DE 69314514 T2 suffers from the following disadvantages:

a) The acoustic signal separation disclosed in this prior art document is based on completely separating an element of the originally measured complete acoustic signal, namely the element referred to as noise. In other words, this document works on the basis of an acoustic scenario in which only a single wanted noise source exists, whose signals are, so to speak, embedded in interference signals from non-localised or less localised sources, in particular vehicle noise. The method disclosed in this prior art document therefore enables this one wanted signal exclusively to be filtered out by completely eliminating all noise signals.

In situations where there is a single wanted acoustic signal, the method disclosed in this document may well produce satisfactory results. However, in view of its basic principle, it is not practical in situations in which not only one wanted sound source but several such sources contribute to the acoustic signal as a whole. This is the case in particular because, in accordance with this teaching, only a single so-called dominant angle of incidence can be processed, namely the angle of incidence at which the acoustic signal with the most energy occurs. All signals which arrive at the microphone from different angles of incidence are necessarily treated as noise b) Furthermore, this document itself appears to work on the assumption that the proposed filtering in the form of a subtraction of the noise spectrum from one of the two frequency spectra does not produce satisfactory results. Consequently, this document additionally proposes that yet another signal processing step should be performed prior to the actual filtering. Effectively, in all frequency bands, once the dominant angle of incidence has been determined, by means of an appropriate phase shift of one of the two acoustic signals in this frequency band to which a Fourier transform has been applied, the noise elements in the respective frequency band are attenuated relative to the wanted acoustic signals which might possibly also be contained in this frequency band. Accordingly, this document regards the filtering process which it discloses, in the form of a subtraction of the noise spectrum, as being unsatisfactory in itself and actually proposes other signal processing steps immediately beforehand, which are performed by separate components provided specifically for this purpose. In particular, in addition to a device for subtracting the noise spectrum (device 24 in the single drawing appended to this document), the system needs means 20 connected upstream to effect a phase shift as well as means 21 to add spectra in the individual frequency bands after phase correction (see the relevant components illustrated in the single drawing appended to this document).

Consequently, the method and the device needed in order to implement it are complex.

Accordingly, the objective of the present invention is to propose a method of separating acoustic signals from a plurality of sound sources and an appropriate device which produces output signals of a sufficient quality purely on the basis of the filtering step, without having to run a phase-corrected addition of acoustic spectra in different frequency bands in order to achieve a satisfactory separation, and which also not only enables signals from a single wanted noise source to be separated from all other acoustic signals but is also capable in principle of separately outputting acoustic signals from a plurality of sound sources without elimination.

This objective is achieved by the invention on the basis of a method as defined in claim 1 and a device as defined in claim 7. Advantageous embodiments of the invention are defined in the respective dependent claims.

The method proposed by the invention requires no convergence time and is able to separate more than two sound sources in space using two microphones, provided they are spaced at a sufficient distance apart. The method is not very demanding in terms of memory requirements and computing power and is very stable with respect to diffuse interference signals. By contrast with the conventional beam forming process, such diffuse interference can be effectively attenuated. As with all methods involving two microphones, the spatial areas between which the process is able to differentiate are rotationally symmetrical with respect to the microphone axis, i.e. with respect to the straight line defined by the two microphone positions. In a section through space containing the axis of symmetry, the spatial area in which a sound source must be located in order to be considered a wanted signal corresponds to a hyperbola. The angle $\theta_0$ which the apex of the hyperbola assumes relative to the axis of symmetry is freely selectable and the width of the hyperbola determined by an angle $\gamma_{3db}$ is also a freely selectable parameter. With only two microphones, output signals can also be created for any other different angles $\theta_0$ and the separation sharpness between the regions decreases with the degree to which the corresponding hyperbolas overlap. Sound sources within a hyperbola are regarded as wanted signals and are attenuated with less than 3 db. Interference signals are eliminated depending on their angle of incidence $\theta$ and an attenuation of >25 db can be achieved for angles of incidence $\theta$ outside of the acceptance hyperbola.

The method operates in the frequency range. The signal spectrum assigned to the one directional hyperbola is obtained by multiplying a correction function K2(x1) and a filter function F(f,T) by the signal spectrum M(f,T) of one of the microphones. The filter function is obtained by spectral smoothing (e.g. by diffusion) of an allocation function $Z(\theta-\theta_0)$ and the computed angle of incidence $\theta$ of a spectral signal component is included in the argument of the allocation function. This angle of incidence $\theta$ is determined from the phase angle $\phi$ of the complex quotient of the spectra of the two microphone signals M2(f,T)/M1(f,T), by multiplying $\phi$ by the acoustic velocity c and dividing by $2\pi fd$, where d denotes the microphone distance. Having been restricted to an amount that is less than or equal to one on the basis of x=K1(x1), the result x1=$\phi c/2\pi fd$, which is also the argument of the correction function K2(x1), gives the cosine of the angle of incidence $\theta$ which is contained in the argument of the allocation function $Z(\theta-\theta_0)$; in the above, K1(x1) denotes another correction function.

Figure 1:
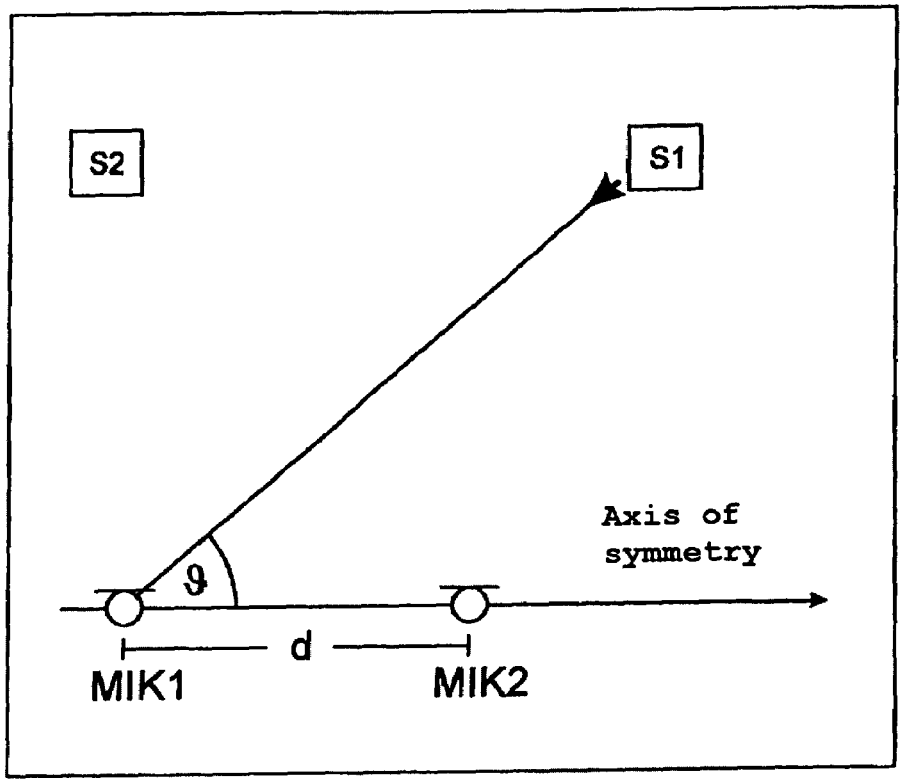
FIG. 1 illustrates the definition of the angle of incidence $\theta$ based on the positions of the two microphones whose signals are processed.

One basic principle of the invention is to allocate an angle of incidence $\theta$ to each spectral component of the incident signal occurring at each instant T and to decide, solely on the basis of the calculated angle of incidence, whether the corresponding sound source lies within a desired directional hyperbola or not. In order to soften the correlation decision slightly, a "soft" allocation function $Z(\theta)$ (FIG. 2) is used instead of a hard yes/no decision, which permits a continuous switch between desired and undesired incidental directions, which advantageously affects the integrity of the signals. The width of the allocation function then corresponds to the width of the directional hyperbola (FIG. 3). The complex spectra of the two microphone signals are divided in order to calculate, firstly, the phase difference $\phi$ for each frequency f at an instant T. The acoustic velocity c and the frequency f of the corresponding signal component are used to calculate, on the basis of the phase difference, a path difference lying between the two microphones when the signal was transmitted from a point source. If the microphone distance d is known, the result is a simple geometric consideration to the effect that the quotient x1 from the path difference and microphone distance corresponds to the cosine of the sought angle of incidence. In practice, due to interference such as diffuse wind noise or spatial echo, an assumption can rarely be made about a point source, for which reason x1 is not usually limited to the anticipated value range [−1,1]. Before the angle of incidence $\theta$ can be calculated, therefore, another correction factor which limits x1 to said range is necessary. If the angle of incidence $\theta(f,T)$ was determined at the instant T for every frequency f, the spectrum of the desired signal is obtained within a directional hyperbola with the apex at the angle $\theta=\theta_0$ by a simple frequency-based multiplication by the spectrum of one of the microphones, in other words $M1(f,T)K(\theta(f,T)-\theta_0)$. Under certain circumstances, it is of advantage to apply spectral smoothing to $K(\theta(f,T)-\theta_0)$ before running the multiplication. Smoothing, the result of which is denoted by $F_{\theta_0}(f,T)$, is obtained by applying a diffusion operator for example. In situations where the variable x used to calculate the angle of incidence lies outside its value range due to the effect of interference, it is of advantage to attenuate the corresponding spectral component of the microphone signal since it may be assumed that interference signals are superimposed. This is done by applying a correction function, for example, the argument of which is the variable x1. If M(f,T) is the corrected microphone signal, the process of creating the desired signal spectrum including spectral smoothing and correction is expressed by $S_{\theta_0}(f,T)=F_{\theta_0}(f,T)M(f,T)$. The time signal $(S_{\theta_0}(t)$ for the corresponding directional hyperbola with apex angle $\theta_0$ is obtained from $S_{\theta_0}(t)$ by applying an inverse Fourier transform.

In other words, one basic idea of the invention is to distinguish noise sources, for example the driver and passenger in a vehicle, from one another in space and thus separate the wanted voice signal of the driver from the interference voice signal of the passenger, for example, making use of the fact that these two voice signals, in other words acoustic signals, as a rule also exist at different frequencies. The frequency analysis provided by the invention therefore firstly enables the overall acoustic signal to be split into the two individual acoustic signals (namely of the driver and of the passenger). Then, with the aid of geometric considerations based on the respective frequency of each of the two acoustic signals and the phase difference between the output signal of microphone 1 and of microphone 2 associated respectively with this acoustic signal, it is "then only" necessary to calculate the direction of incidence of each of the two acoustic signals. Since, in a hands-free system in the vehicle, the geometry between the position of the driver, the position of the passenger and the position of the microphones is more or less known, the wanted acoustic signal which has to be further processed can be separated from the interference acoustic signal on the basis of its different angle of incidence.

A detailed explanation of an example of an embodiment of the invention will be given with reference to the appended drawings.

Figure 4:
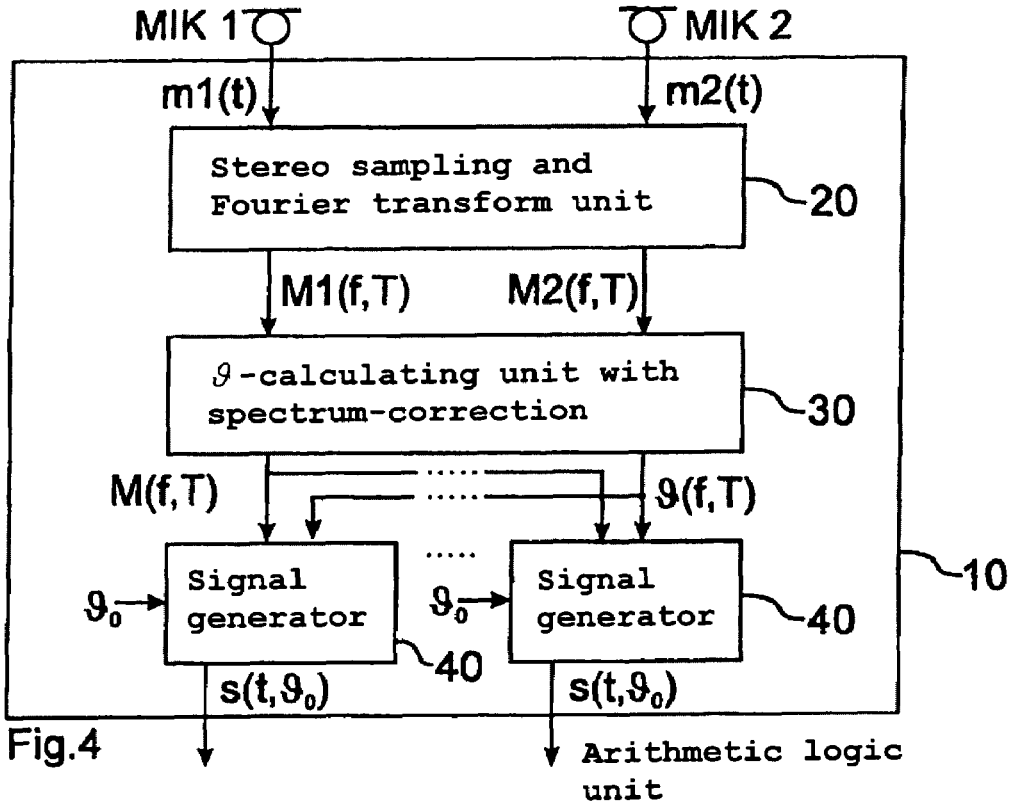
FIG. 4 illustrates the structure of the source separator in which the time signals of two microphones, m1(t) and m2(t), are transformed in a stereo-sampling and Fourier transform unit (20) to produce spectra M1(f,T) and M2(f,T), where T denotes the instant at which the spectra occur. From the spectra, the frequency-dependent angle of incidence $\theta$(f,T) as well as the corrected microphone spectrum M(f,T) are calculated in the $\theta$-calculating unit (30), from which output signals $S_{\theta_0}(t)$ are produced in signal generators (40) for different directional angles $\theta_0$.
Figure 5:
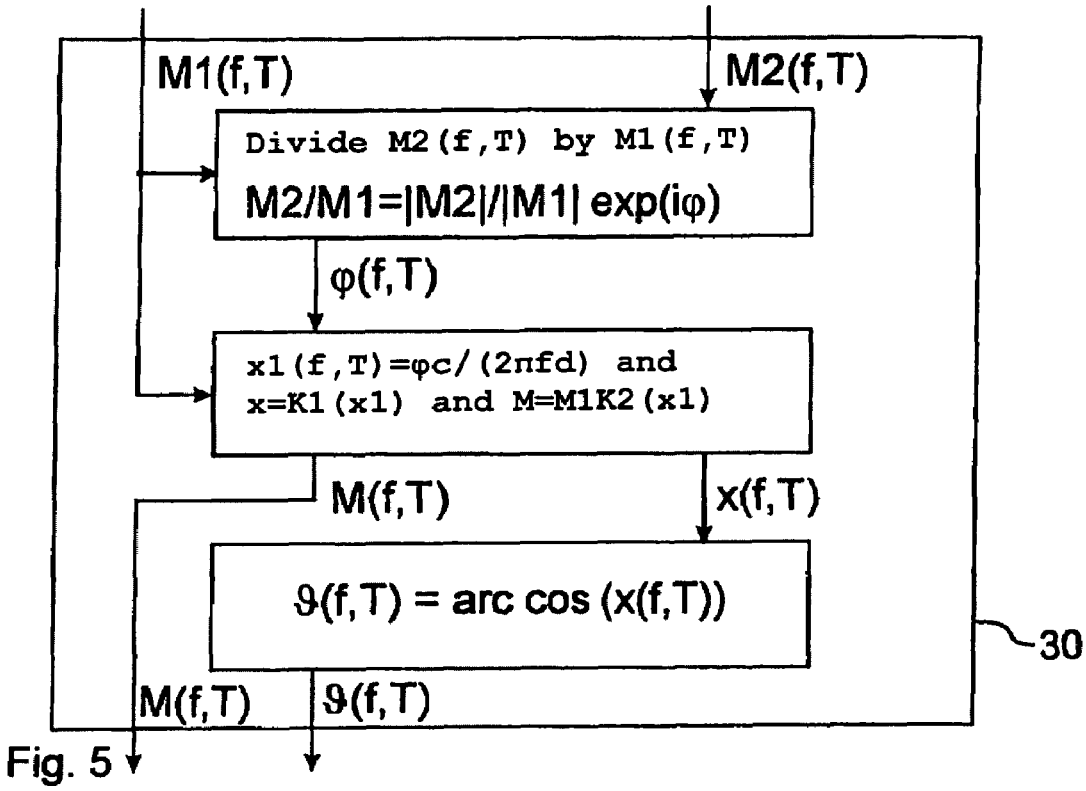
FIG. 5 illustrates the structure of the $\theta$-calculating unit (30), in which the phase angle $\phi$(f,T) of a spectral component of the complex quotient of the two microphone spectra M1(f,T) and M2(f,T) is calculated, which then has to be multiplied by the acoustic velocity c and divided by $2\pi fd$, where d notes the microphone distance. This operation gives the variable x1(f,T) which represents the argument of the two correction functions K2 and K1. These correction functions give the corrected microphone spectrum M(f,T) =M1(f,T)*K2(x1(f,T)) and the variable x(f,T)=K1(x1(f,T)), from which the angle of incidence $\theta$(f,T) is calculated by applying the inverse cosine function.

The time signals m1(t) and m2(t) of two microphones which are disposed at a fixed distance d from one another are applied to an arithmetic logic unit (10) (FIG. 4), where they are discretized and digitised in a stereo sampling and Fourier transform unit (20) at a sampling rate $f_A$. A Fourier transform is applied to a sequence of a sampling values of each of the respective microphone signals m1(t) and m2(t) to obtain the transformed complex value spectrum M1(f,T) respectively M2(f,T), in which f denotes the frequency of the respective signal component and T specifies the instant at which a spectrum occurs. In terms of the practical application, the following selection of parameters is suitable: $f_A$=11025 Hz, a=256, T a/2=t. If computing capacity and memory space permit, however, a=1024 is preferred. The microphone distance d should be shorter than the half wavelength of the highest frequency to be processed, which is obtained from the sampling frequency, i.e. $d<c/4f_A$. For the parameter selection specified above, a microphone distance d=20 mm is suitable.

Figure 7:
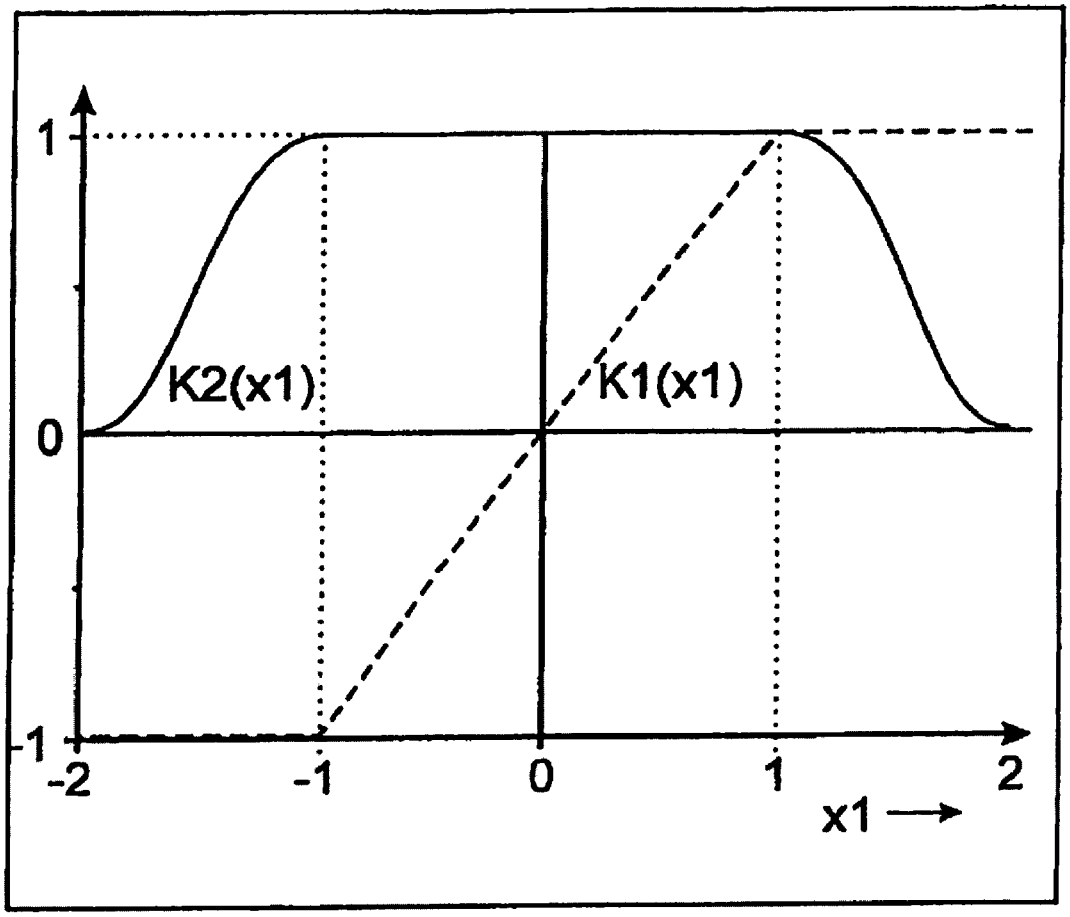
FIG. 7 illustrates examples of the two correction functions K2(x1) and K1(x1).

The spectra M1(f,T) and M2(f,T) are forwarded to a $\theta$-calculating unit with spectrum correction (30), which calculates an angle of incidence $\theta(f,T)$ from the spectra M1(f,T) and M2(f,T), which specifies the direction from which a signal component with a frequency f arrives at the microphones at the instant T relative to the microphone axis (FIG. 1). To this end, M2(f,T) and M1(f,T) are subjected to a complex division. $\phi(f,T)$ denotes the phase angle of this quotient. In situations where confusion can be ruled out, the argument (f,T) of the time- and frequency-dependent variables is omitted below. Based on the Euler formula and the arithmetic rules for complex numbers, the exact arithmetic rule for determining $\phi$ is as follows:

$$\phi=\arctan((Re1*Im2-Im1*Re2)/(Re1*Re2+Im1*Im2)),$$

where Re1 and Re2 denote the real parts and Im1 and Im2 denote the imaginary parts of M1, respectively M2. The variable $x1=\phi c/2\pi fd$ is obtained on the basis of the acoustic velocity c from the angle $\phi$, x1 also being dependent on frequency and time: x1=x1(f,T). In practice, the range of values for x1 must be limited to the interval [−1,1] with the aid of a correction function x=K1(x1) (FIG. 7). Taking the variable x calculated in this manner, an inverse cosine function is applied in order to calculate an angle of incidence $\theta$ of the relevant signal component to be measured from the microphone axis, i.e. from the straight line defined by the positions of the two microphones (FIG. 1). Taking account of all the dependencies, the angle of incidence of a signal component with frequency f at the instant T is therefore: $\theta(f,t)=\arccos(x(f,T))$. The microphone spectrum is also corrected with the aid of a second correction function K2(x1) (FIG. 7): M(f,T)=K2(x1)M1(f,T). The purpose of this correction is to reduce the corresponding signal component in situations where the first correction function applies because it may be assumed that there is superposed interference which distorts the signal. The second correction is optional or M(f,T)=M1(f,T) may also be selected as an alternative; M(f,T)=M2(f,T) is also possible.

The spectrum M(f,T) together with the angle $\theta(f,T)$ is forwarded to one or more signal generators (40) where a signal to be output $S_{\theta_0}(t)$ is respectively obtained with the aid of an allocation function $Z(\theta)$ (FIG. 2) and a selectable angle $\theta_0$. This is done by multiplying every spectral component of the spectrum M(f,T) by the corresponding component of a $\theta_0$-specific filter $F_{\theta_0}(f,T)$ at an instant T. $F_{\theta_0}(f,T)$ is obtained by a spectral smoothing of $Z(\theta-\theta_0)$. This smoothing is obtained, for example, by spectral diffusion:

$$F_{\theta_0}(f,T)=Z(\theta(f,T)-\theta_0)+D\Delta^2_f Z(\theta(f,T)-\theta_0).$$

In the above, D denotes the diffusion constant which is a freely selectable parameter greater than or equal to zero. The discrete diffusion operator $\Delta^2_f$ is an abbreviation for $$\Delta^2_f Z(\theta(f,T)-\theta_0))=(Z(\theta(f-f_A/a),T)-\theta_0)-2Z(\theta(f,T)-\theta_0))+Z)\theta(f+f_A/a,T)-\theta_0))/(f_A/a)^2.$$

The quotient $f_A/a$ obtained from the sampling rate $f_A$ and number a of sampling values corresponds to the distance of two frequencies in the discrete spectrum. Applying the resultant filter $F_{\theta_0}(f,T)$ will give a spectrum $S_{\theta_0}(f,T)=F_{\theta_0}(f,T)M(f,T)$, which is transformed into the time signal $s\theta_0(t)$ by inverse Fourier transform.

The signal $S_{\theta_0}(t)$ to be output by a signal generator (40) corresponds to the acoustic signal within that area of space defined by the allocation function $Z(\theta)$ and the angle $\theta_0$. For the sake of simplicity, only one allocation function $Z(\theta)$ will be used in the nomenclature selected for different signal generators and different signal generators will use only different angles $\theta_0$. In practice, there is nothing to say that a separate form of the allocation function can not be selected in each signal generator as well. Applying allocation functions permitting a decision as to different areas of space to which signal components belong is one of the central principles of the invention. An allocation function must be a direct function and appropriate functions are, for example, $Z(\theta)=((1+\cos\theta)/2)^n$ with a parameter n>0. The spatial area in which signals are attenuated with less than 3 db corresponds to a hyperbola with a beam angle $2\gamma_{3db}$ (FIG. 3) and apex at the angle $\theta_0$. Accordingly, $2\gamma_{3db}$ corresponds to the half-value angle of the allocation function $Z(\theta)$ (FIG. 2), where the specified formula for the allocation function is $\gamma_{3db}=\arccos(2^{1-1/n}-1)$. In these two-dimensional geometric considerations, it must be borne in mind that the actual area of the three-dimensional space from which acoustic signals are extracted with the described method is a hyperboloid of revolution, obtained by rotating the described hyperbola about the microphone axis.

Naturally, the present invention is not limited to use in motor vehicles and hands-free units. Other applications are conference telephone systems in which several directional hyperbola are disposed in different spatial directions in order to extract the voice signals of individual persons and prevent feedback or echo effects. The method may also be combined with a camera, in which case the directional hyperbola always looks in the same direction as the camera so that only acoustic signals arriving from the image area are recorded. In picture-phone systems, a monitor is simultaneously connected to the camera, in which the microphone system can also be integrated in order to generate a directional hyperbola perpendicular to the monitor surface, since it can be expected that the speaker is located in front of the monitor.

A totally different class of applications becomes possible if, instead of evaluating the signal to be output, the angle of incidence θ to be determined is evaluated, which is then determined by averaging over frequencies f at an instant T, for example. This type of θ(T) evaluation may be used for monitoring purposes if the position of a sound source is to be located in an otherwise quiet area.

Figure 2:
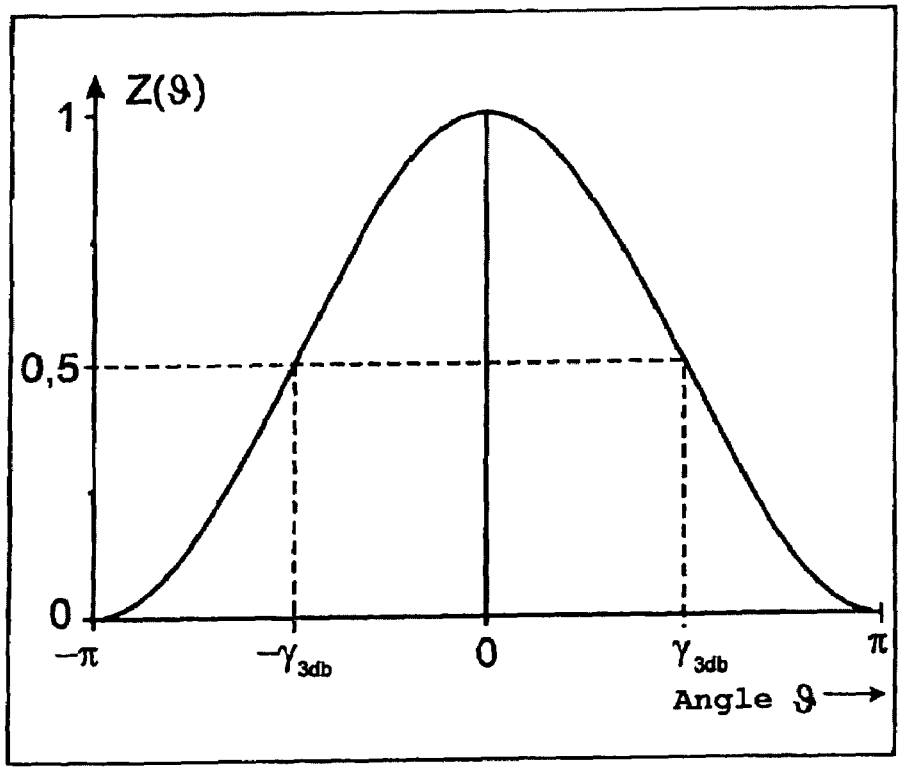
FIG. 2 illustrates an example of an allocation function $Z(\theta)$ with half-value width $2\gamma_{3db}$, which results in a hyperbola with the apex at $\theta=0$.
Figure 3:
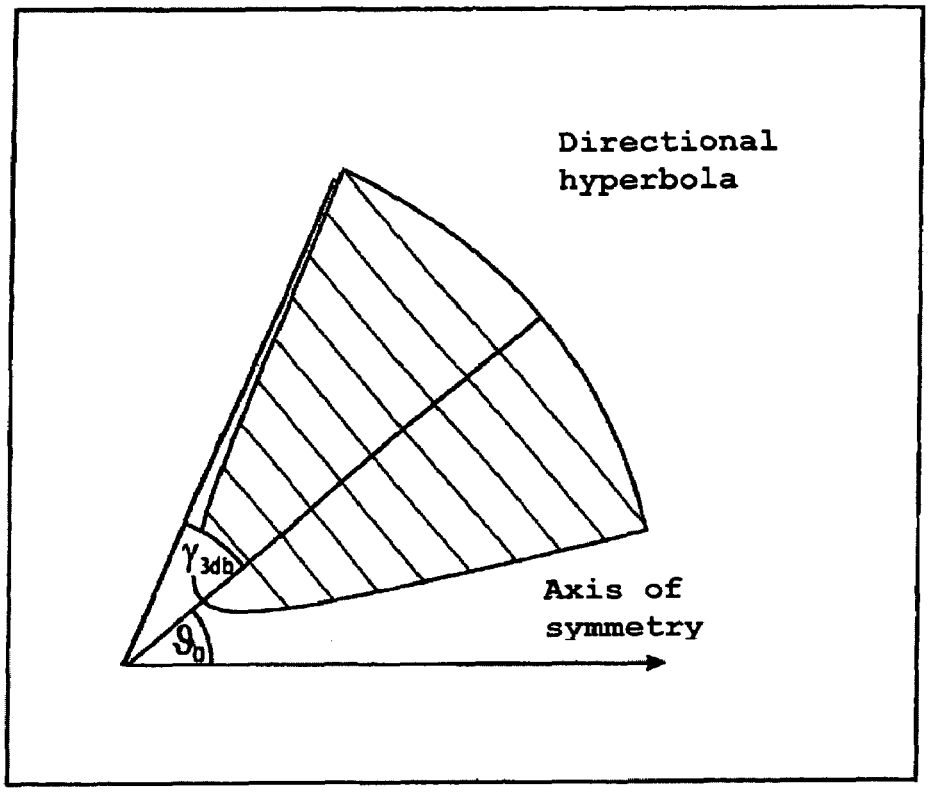
FIG. 3 illustrates a hyperbola with the apex at $\theta=\theta_0$, which determines the directional characteristic of the source separation. Signals within the spatial area defined by the hyperbola are output as a wanted signal with an attenuation <3 db.
Figure 6:
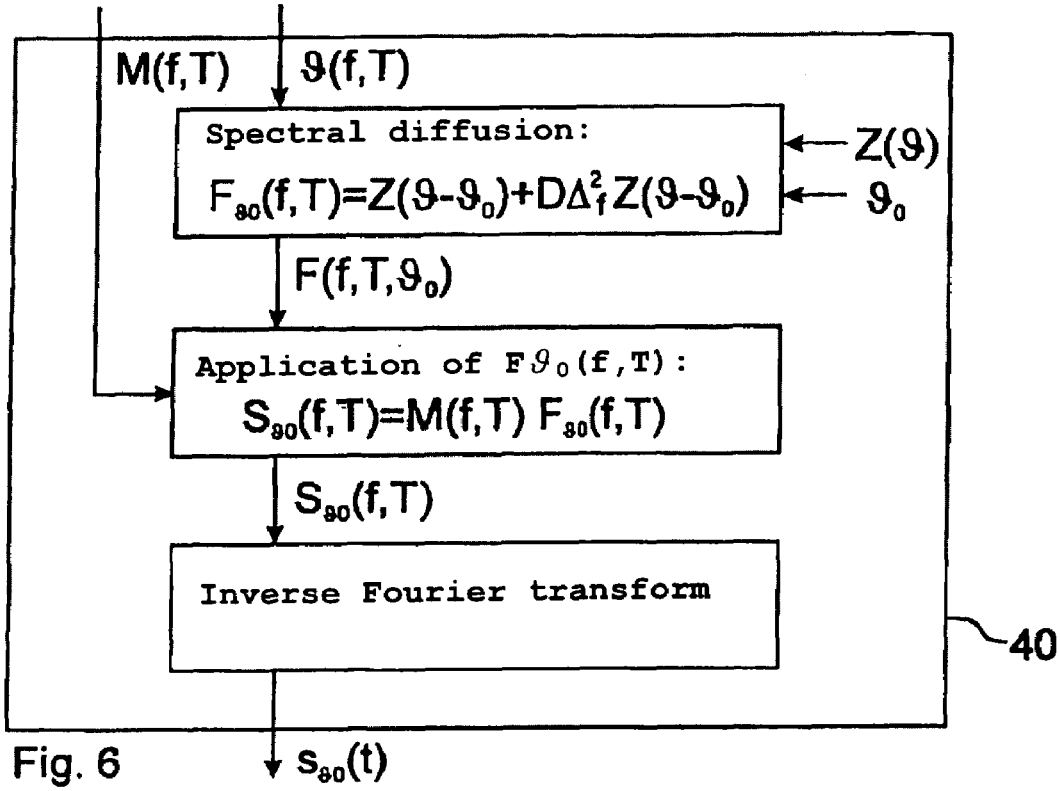
FIG. 6 illustrates a signal generator in which an allocation function $Z(\theta-\theta_0)$ with an adjustable angle $\theta_0$ is smoothed by spectral diffusion to obtain a filter function F(f,T), which is multiplied by the corrected microphone spectrum M(f,T). This results in an output spectrum $S_{\theta_0}$(f,T), from which an output signal $S_{\theta_0}(t)$ is obtained by applying an inverse Fourier transform, which contains the acoustic signals within the spatial area fixed by the allocation function Z and the angle $\theta_0$.

Correct "separation" of the desired area corresponding to the wanted acoustic signal to be separated from a microphone spectrum need not necessarily be obtained by multiplying with a filter function as illustrated by way of example in FIG. 6, the allocation function of which is plotted by way of example in FIG. 2. Any other way of correlating the microphone spectrum with a filter function would be appropriate, provided this filter function and this correlation cause values in the microphone spectrum to be more intensely "attenuated" the farther their allocated angles of incidence θ are from the preferred angle of incidence $\theta_0$ (for example the direction of the driver in the vehicle).

LIST OF REFERENCE NUMBERS

10 Arithmetic logic unit for running the method steps proposed by the invention
20 Stereo sampling and Fourier transform unit
30 θ-calculating unit
40 Signal generator
a Number of sampling values transformed to the spectra M1, respectively M2
d Microphone distance
D Diffusion constant, selectable parameters greater than or equal to zero
$\Delta^2_f$ Diffusion operator
f Frequency
$f_A$ Sampling rate
K1 First correction function
K2 Second correction function
m1(t) Time signal of the first microphone
m2(t) Time signal of the second microphone
M1(f,T) Spectrum of the first microphone signal at the instant T
M2(f,T) Spectrum of the second microphone signal at the instant T
M(f,t) Spectrum of the corrected microphone signal at the instant T
$S_{\theta_0}(t)$ Time signal generated corresponding to an angle $\theta_0$ of the directional hyperbola
$S_{\theta_0}(f,T)$ Spectrum of the signal $s\theta_0(t)$
$\gamma_{3db}$ Angle determining the half-value width of an allocation function $Z(\theta)$
ϕ Phase angle of the complex quotient M2/M1
θ(f,T) Angle of incidence of a signal component, measured from the microphone axis
$\theta_0$ Angle of the apex of a directional hyperbola, parameters in $Z(\theta-\theta_0)$
x, x1 Intermediate variables in the θ-calculation
t Time basis of the signal sampling
T Time basis for generating the spectrum
$Z(\theta)$ Allocation function

The invention claimed is:

1. Method of separating acoustic signals from a plurality of sound sources (S1, S2), comprising the following steps:

disposing two microphones (MIK1, MIK2) at a predefined distance (d) from one another;

picking up the acoustic signals with both microphones (MIK1, MIK2) and generating associated microphone signals (m1, m2); and separating the acoustic signal of one of the sound sources (S1) from the acoustic signals of the other sound sources (S2) on the basis of the microphone signals (m1, m2), in which the separation step comprises the following steps:

applying a Fourier transform to the microphone signals in order to determine their frequency spectra (M1, M2);

determining the phase difference ($\phi$) between the two microphone signals (m1, m2) for every frequency component of their frequency spectra (M1, M2);

determining the angle of incidence ($\theta$) of every acoustic signal allocated to a frequency of the frequency spectra (M1, M2) on the basis of the phase difference ($\phi$) and the frequency;

generating a signal spectrum (S) of a signal to be output by correlating one of the two frequency spectra (M1, M2) with a filter function ($F_{\theta_0}$) which is selected so that acoustic signals from an area ($\gamma_{3db}$) around a preferred angle of incidence ($\theta_0$) are amplified relative to acoustic signals from outside this area ($\gamma_{3db}$); and applying an inverse Fourier transform to the resultant signal spectrum, characterised in that the filter function ($F_{\theta_0}$) is dependent on the angle of incidence $\theta$ and has a maximum at the preferred angle of incidence ($\theta_0$) when the angle of incidence $\theta$ is varied, and the correlation of the filter function ($F_{\theta_0}$) with one of the two frequency spectra comprises multiplying the same.

2. Method as claimed in claim 1, characterised in that the filter function ($F_{\theta_0}$) is expressed as follows:

$$F_{\theta_0}(f,T)=Z(\theta-\theta_0)+D\Delta^2_f Z(\theta-\theta_0)$$

in which f is the respective frequency

T is the instant at which the frequency spectra (M1, M2) are determined $Z(\theta-\theta_0)$ is an allocation function with a maximum at $\theta_0$ $D \geqq 0$ is a diffusion constant and $\Delta^2$ is a discrete diffusion operator.

3. Method as claimed in claim 2, characterised in that the allocation function (Z) is expressed as follows:

$$Z(\vartheta-\vartheta_0)=\left(\frac{1+\cos(\vartheta-\vartheta_0)}{2}\right)^n$$

where $$n>0.$$

4. Method as claimed in claim 1, characterised in that the angle of incidence $\theta$ is determined by the equation $$\theta \arccos(x(f,T))$$

with $$x(f,T)\phi,c/2\pi fd$$

where $\phi$ is the phase difference between the two microphone signal components (m1, m2)

c is the acoustic velocity f is the frequency of the acoustic signal component and d is the predefined distance of the two microphones (MIK1, MIK2).

5. Method as claimed in claim 4, characterised in that it additionally incorporates the following step:

limiting the value of x(f,T) to the interval [−1,1].

6. Method as claimed in claim 5, characterised in that it additionally incorporates the following step:

reducing signal components whose value of x(f,T) lay outside of the interval [−1,1] prior to limitation.

7. Device for implementing the method as claimed in claim 1, comprising:

two microphones (MIK1, MIK2);

a sampling and Fourier transform unit (20) connected to the microphones for discretizing and digitising the microphone signals (m1, m2) and applying a Fourier transform to them;

a calculating unit (30) connected to the sampling and Fourier transform unit (20) for calculating the angle of incidence ($\theta$) of every acoustic signal component; and at least one signal generator (40) connected to the calculating unit (30) for outputting the separated acoustic signal, at least one signal generator (40) having means for multiplying one of the Fourier transformed frequency spectra (M1, M2) by a filter function ($F_{\theta_0}$) which is dependent on $\theta$ and has a maximum at a preferred angle of incidence ($\theta_0$) when $\theta$ is varied.

8. Device as claimed in claim 7, characterised in that the distance (d) between the microphones satisfies the equation:

$$d<c/4f_A$$

where c is the acoustic velocity and $f_A$ is the sampling frequency of the stereo sampling and Fourier transform unit (20).

9. Device as claimed in claim 7, characterised in that the device has a signal generator (40) for every sound source (S1, S2) to be separated.

* * * * *

UNITED STATES PATENT AND TRADEMARK OFFICE

CERTIFICATE OF CORRECTION

PATENT NO. : 7,327,852 B2
APPLICATION NO. : 10/557754
DATED : February 5, 2008
INVENTOR(S) : Dietmar Ruwisch It is certified that error appears in the above-identified patent and that said Letters Patent is hereby corrected as shown below:

At column 9, line 30, please replace "D≧0" with "D ≥ 0".

At column 9, line 31, please replace "$\Delta^2$" with "$\Delta^2_f$".

At column 9, line 44, please replace "$\theta$ arc cos(x(f,T))" with "$\vartheta$ =arc cos(x(f,T))".

At column 10, line 2, please replace "x(f,T)φ,c/2πfd" with "x(f,T)=φc/2πfd"

Signed and Sealed this

Thirtieth Day of December, 2008

JON W. DUDAS
*Director of the United States Patent and Trademark Office*